United States Patent [19]

Inkman et al.

[11] Patent Number: 4,852,178

[45] Date of Patent: Jul. 25, 1989

[54] SPEAKER RETAINING ASSEMBLY

[75] Inventors: William P. Inkman, Grapevine; Cesario S. Garza, Saginaw; Ted A. Cusumano, Fort Worth, all of Tex.

[73] Assignee: Motorola, Inc., Schaumburg, Ill.

[21] Appl. No.: 103,786

[22] Filed: Oct. 2, 1987

[51] Int. Cl.[4] ..... G10K 13/00

[52] U.S. Cl. ..... 381/205; 181/171

[58] Field of Search ..... 181/148, 150, 158, 171, 181/172, 175; 381/169, 188, 205

[56] References Cited

U.S. PATENT DOCUMENTS 711,640 10/1902 Miner ..... 381/205

2,452,830 11/1948 Braun ..... 381/169 X

FOREIGN PATENT DOCUMENTS 2706524 8/1978 Fed. Rep. of Germany ..... 181/150

OTHER PUBLICATIONS

BNC Coaxial Connectors-pp. 41 and 43.

Weed Eater Operator's Manual for Model XR-20, pp. 14 and 15.

ISE In-Sink-Erator Garbage Disposal Manual.

*Primary Examiner*—L. T. Hix

*Assistant Examiner*—Brian W. Brown

*Attorney, Agent, or Firm*—Steven G. Parmelee

[57] ABSTRACT

A speaker retaining assembly (10) that includes a support unit (12) having latches (13) disposed thereon. A retaining ring (14) functions to secure a speaker (11) in place with respect to the support unit (12). The retaining ring (14) includes an appropriately configured plurality of cavities (21) that interact with the latches (13) to so secure the speaker (11). A resilient member (36) can be utilized to bias the retaining ring (14) with respect to the latches (13) to further ensure the securement.

4 Claims, 2 Drawing Sheets

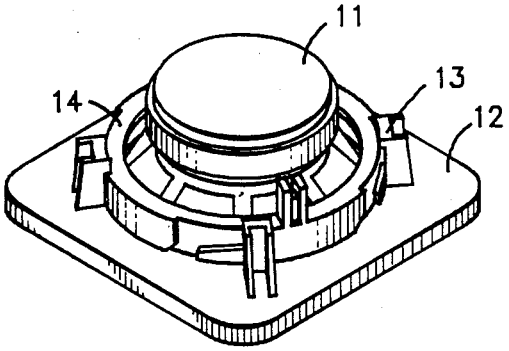
FIG. 4
FIG. 5
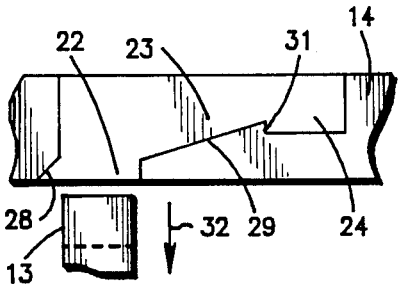
FIG. 7
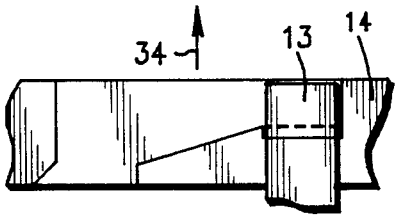
FIG. 6
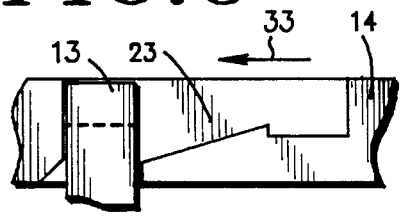
FIG. 8
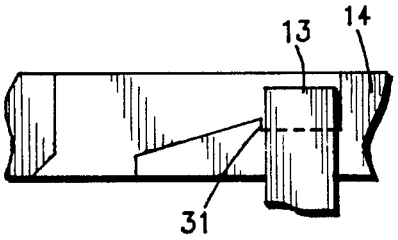
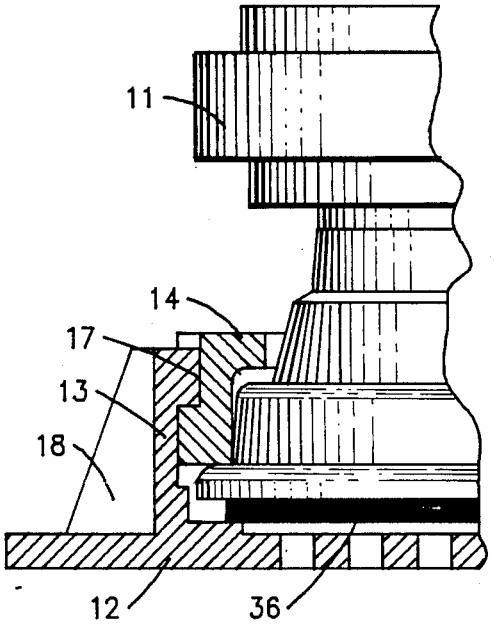
FIG. 9

SPEAKER RETAINING ASSEMBLY

TECHNICAL FIELD

This invention relates generally to speaker retention assemblies, particularly when used in two-way radios.

BACKGROUND ART

Two-way RF radios allow verbal communications to be conducted wirelessly at a distance, as between an individual in, for instance, a building and an individual in a vehicle. To facilitate this, the electronic signals that represent the voice signal (subsequent to appropriate demodulation in the radio to recover this signal) are transduced into an audio signal, usually through use of a speaker.

Use of speakers in two-way radios presents a number of problems, particularly in a mobile radio setting. For instance, it becomes very important that as complete as possible an acoustic seal between the speaker and its mounting structure be achieved. The failure to achieve a good acoustic seal leads to diminished audio reproduction capability, which can be particularly troublesome in a vehicle mounted radio ordinarily subject to operation in noisy ambient conditions. Also, such vehicle mounted radios are subject to significant vibration due to environmental stimuli, and such vibration can reduce an otherwise satisfactory acoustic seal and/or lead to damage of the speaker and surrounding components.

In the past, speakers in two-way radios have typically been mounted by using either speakers having an integrally formed square basket associated therewith, which basket can be attached through use of screws (typically 4) to a support surface, or through use of a mounting bracket that fits about a speaker and, through use of screws, affixes the speaker to the support surface. Unfortunately, these techniques are unduly sensitive to vibration, and do not necessarily provide an adequate acoustic seal. In addition, the use of a plurality of screws or other threaded members requires a commensurate manufacturing effort that increases the cost of manufacturing the radio.

A need therefore exists for a speaker retention assembly that ensures an acceptable acoustic seal, both upon initial use and thereafter, which assembly is substantially immune to ordinary vibration conditions and which represents a minimum manufacturing cost.

SUMMARY OF THE INVENTION

These needs and others are substantially met through provision of the speaker retaining assembly having a support unit for supporting a speaker and a ring unit for contacting the speaker and for being rotatably movable from a first unlatched position to a second latched position, such that when the ring unit is in the second latched position, the speaker will be substantially fixed in place with respect to the support unit.

In one embodiment, the ring unit can include cavities formed therein that interact with latches that are peripherally disposed about the speaker and connected to the support unit. A biasing unit, such as a resilient gasket, which may be mounted on the speaker itself, can serve to bias the ring unit away from the support unit, and thereby force the appropriate interaction between the ring unit and the latches.

In another embodiment, handles may be provided on the ring unit to facilitate rotation of the ring when moving the ring unit from the first position to the second unit. These handles may have appropriate apertures formed therein to allow reception of an appropriate tool to accomplish this, which tool may be robotically controlled.

BRIEF DESCRIPTION OF THE DRAWINGS

These and other attributes of the invention will become more clear upon making a thorough review and study of the following description of the best mode for carrying out the invention, particularly when reviewed in conjunction with the drawings, wherein:

FIG. 4 comprises the view of FIG. 3 with the ring unit in the latched position;

FIGS. 5 comprises an enlarged elevational detail view of the ring unit and a latch;

FIG. 6 comprises the view of FIG. 5 with the ring unit and latch in the unlatched position;

FIG. 7 comprises the view of FIG. 6 wherein the ring unit has been rotated with respect to the latch;

FIG. 8 comprises the view of FIG. 7 wherein the ring unit and latch are in the latched position; and FIG. 9 comprises a side elevational partially sectioned view of the speaker as affixed to the support unit through use of the ring unit.

BEST MODE FOR CARRYING OUT THE INVENTION

Figure 1:
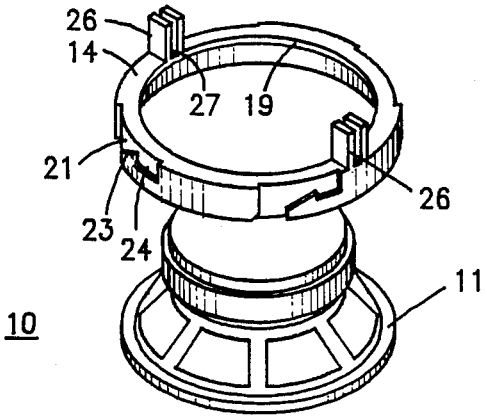
FIG. 1 comprises a perspective view of the support unit, the speaker, and the ring unit.

Referring now to the drawings, and in particular to FIG. 1, the apparatus of the invention can be seen as depicted generally by the numeral 10 and operates in conjunction with a speaker (11). The assembly (10) includes a support unit (12), latches (13), and a retaining ring (14). Each of these components will now be described in more detail in seriatim fashion.

The speaker (11) can be any appropriate prior art or hereafter available structure. In this particular embodiment, the speaker (11) does not include a mounting basket integrally formed therewith.

The support unit (12) can be comprised of a substantially planar member formed, for example, of plastic. The support surface (12) can have a plurality of holes (16) formed therethrough to allow sound emitted from the speaker (11) to pass therethrough and be heard.

The latches (13) are affixed to the support unit (12), and in this embodiment, are comprised of plastic and formed integrally with the support unit (12). The latches (13) are disposed on the support unit (12) such that they will be positioned peripherally about the speaker (11) when the speaker (11) is appropriately located on the support surface (12) (see FIG. 2). Each latch (13) includes a flange (17) that extends in a cantilevered fashion inwardly. The purpose of this flange (17) will be made more evident below. In addition, a gusset (18) can be provided to ensure the structural integrity of the latches (13).

The retaining ring (14) comprises an annular shaped member having an upper tab (19) that extends inwardly. Additionally, on the exterior side of the retaining ring (14), formed cavities (21) are provided to interact with the latches (13). Each cavity (21) includes an entry aperture (22) to allow entry of the latch (13) and a channel cavity (23) to allow passage of the latch (13). Finally, a latch reception cavity (24) provides an appropriate interface with the latch (13) as described below in more detail.

In this particular embodiment, the retaining ring (14) also has two handles (26) formed integrally therewith to facilitate rotation of the retaining ring (14) with respect to the support unit (12). These handles (26) include slots (27) formed therein to allow reception of an appropriate tool, which tool may be robotically manipulated.

Referring now to FIG. 5, additional detail regarding the retaining ring (14) will be set forth. In particular, the cavity (21) described above can be seen to include, as regards the entry aperture (22), a first cam surface (28) to allow easier positioning of the retaining ring (14) with respect to the latches (13) when seeking to cause the latches (13) to become disposed within the entry aperture (22). Similarly, the channel cavity (23) includes a second cam surface (29) to facilitate rotation of the retaining ring (14) once the latch (13) has been appropriately positioned. Finally, the latch reception cavity (24) includes a notched area (31), which notch (31) serves as the latch mechanism that interacts with the latch (13) to prevent reverse rotation of the retaining ring (14).

A description of the use of the assembly (10) can now be set forth.

Figure 2:
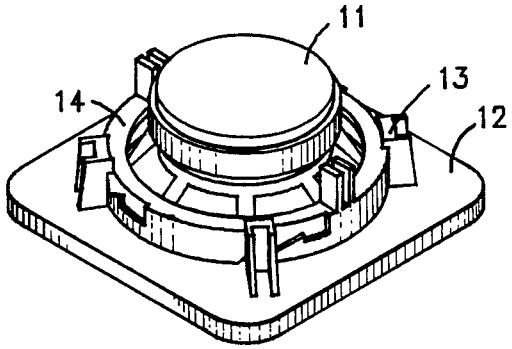
FIG. 2 comprises the view of FIG. 1 wherein the speaker is resting upon the support unit.
Figure 2:
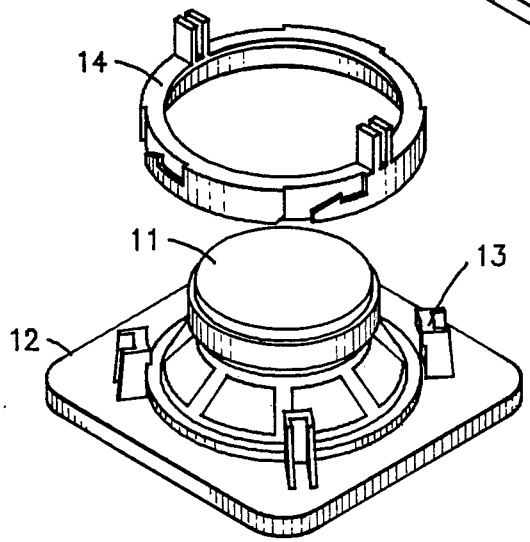

Referring to FIG. 2, the speaker (11) can be disposed on the support unit (12) such that the latches (13) are peripherally disposed about the speaker (13).

Figure 3:
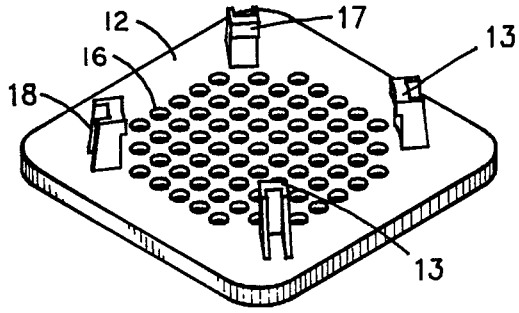
FIG. 3 comprises the view of FIG. 2 wherein the ring unit is disposed over the speaker, with the ring unit in the unlatched position.

With reference to FIGS. 5 and 6, the retaining ring (14) can then be disposed over the combined speaker (11)/support unit (12) assembly with the latches (13) substantially aligned with the entry apertures (22) of the retaining ring (14). The retaining ring (14) can then be moved towards the support unit (12) as depicted by the arrow (32) in FIG. 5 until the latch (13) has completely entered the entry aperture (22) and as also depicted in FIG. 3.

The retaining ring (14) may then be rotated in the direction indicated by the arrow (33) appearing in FIG. 6 to cause the flange (17) of the latch (13) to move through the channel cavity (23) until it has entered the latch reception cavity (24) as depicted in FIG. 7 and FIG. 4.

The retaining ring (14) can then be caused to move away from the support surface (12) in the direction indicated by the arrow (34) appearing in FIG. 7 until the flange (17) of the latch (13) has become locked within the latch reception cavity (24) with respect to the notch (31) described above. So positioned, the speaker (11) will be locked in place and substantially impaired from further movement. Simultaneously, the retaining ring (14) will cause the speaker (11) to be in contact with the support surface (12) about its entire periphery, thereby providing an excellent acoustic seal, which acoustic seal is substantially immune to normal vibrations that occur in the operating environment of the radio.

With particular reference to FIG. 9, a resilient gasket (36) can be provided and disposed between the speaker (11) and the support unit (12). This gasket will not only improve the acoustic seal, but will also serve to bias the speaker (11) and urge it away from the support unit (12). This in turn will cause the retaining ring (14) to be urged away from the support unit (12) such that the biasing action of the gasket (36) serves to aid in causing the latch (13) to remain interlocked with the retaining ring (14).

To remove the retaining ring (14) and thereby remove the speaker (11), it becomes necessary to actually urge the retaining ring (14), and hence the speaker (11), towards the support unit (12) in order to free the latch flange (17) from the notch (31) provided in the retaining ring (14) to allow reverse rotation and subsequent removal of the retaining ring (14). Such unintended movement by the speaker and retaining ring are quite unlikely in a radio environment, and hence the stability of the assembly (10) proves quite secure.

In the embodiment depicted, the resilient gasket (36) can be provided in the first instance around the periphery of the speaker cone, in accordance with well understood prior art technique.

Those skilled in the art will recognize that various modifications could be made to the invention without departing from the spirit and scope of the invention. It should therefore be understood that the claims are not to be considered as being limited to the embodiments set forth, in the absence of express limitations directed to such embodiments.

We claim:

1. A speaker retaining assembly for use with a speaker, said assembly comprising:
   (A) support means for supporting said speaker;
   (B) ring means for contacting said speaker, and for being rotatably moveable from a first unlatched position to a second latched position, such that when said ring means is in said second latched position, said speaker is substantially fixed in place with respect to said support means, and wherein said ring means further includes handles disposed thereon to facilitate rotation of said ring means, said handles having a slot formed therein to allow reception of a tool, which tool can be used to rotate said ring means.

2. A speaker retaining assembly for use with a speaker, said assembly comprising:
   (A) support means for supporting said speaker;
   (B) a plurality of latches disposed on and affixed to said support means, such that said speaker can be supported by said support means with at least some of said plurality of latches disposed peripherally thereabout;
   (C) retaining means for interacting with said plurality of latches and said speaker, wherein said retaining means includes:
      (i) ring means for disposition about said speaker, wherein said ring means can be rotated from a first unlatched position to a second latched position;
      (ii) latch contacting means for interacting with said plurality of latches when said ring means is in said second latched position, including notch means formed in said ring means for blocking said latches and thereby preventing unintentional reverse rotation of said ring means.

3. The speaker retaining assembly of claim 2 and further including biasing means for urging said latch contacting means into interaction with said latches when said ring means is in said second latched position.

4. The speaker retaining assembly of claim 2 wherein:
   each of said plurality of latches includes a flange extending therefrom that interacts with the notch means.

* * * * *